US009424767B2

(12) United States Patent
Fleck et al.

(10) Patent No.: US 9,424,767 B2
(45) Date of Patent: Aug. 23, 2016

(54) LOCAL RENDERING OF TEXT IN IMAGE

(75) Inventors: Rod G. Fleck, Bellevue, WA (US); Stephen Latta, Seattle, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 296 days.

(21) Appl. No.: 13/526,290

(22) Filed: Jun. 18, 2012

(65) Prior Publication Data

US 2013/0335442 A1 Dec. 19, 2013

(51) Int. Cl.
*G09G 5/00* (2006.01)
*G09G 3/00* (2006.01)

(52) U.S. Cl.
CPC ..... *G09G 3/003* (2013.01); *G09G 2320/068* (2013.01); *G09G 2320/0666* (2013.01); *G09G 2320/0673* (2013.01); *G09G 2340/0407* (2013.01); *G09G 2340/06* (2013.01); *G09G 2354/00* (2013.01)

(58) Field of Classification Search
CPC ..... G06T 11/60; G09G 5/00
See application file for complete search history.

(56) References Cited

U.S. PATENT DOCUMENTS

| | | | | |
|---|---|---|---|---|
| 7,373,597 | B2 | 5/2008 | Hagerty et al. | |
| 7,743,324 | B1 | 6/2010 | Bever et al. | |
| 8,648,858 | B1 * | 2/2014 | Swenson et al. | 345/428 |
| 2007/0067718 | A1 | 3/2007 | Malkin et al. | |
| 2007/0150827 | A1 * | 6/2007 | Singh et al. | 715/773 |
| 2007/0288844 | A1 * | 12/2007 | Zingher et al. | 715/529 |
| 2008/0002893 | A1 * | 1/2008 | Vincent et al. | 382/229 |
| 2008/0101456 | A1 * | 5/2008 | Ridge et al. | 375/240.01 |
| 2008/0136831 | A1 * | 6/2008 | Kim | 345/537 |
| 2008/0148314 | A1 | 6/2008 | Shintani et al. | |
| 2009/0023428 | A1 * | 1/2009 | Behzad et al. | 455/414.3 |
| 2009/0262126 | A1 | 10/2009 | Zhang et al. | |
| 2010/0056274 | A1 * | 3/2010 | Uusitalo et al. | 463/31 |
| 2010/0123737 | A1 * | 5/2010 | Williamson et al. | 345/672 |
| 2010/0253702 | A1 * | 10/2010 | Gotoh | 345/660 |
| 2010/0257252 | A1 * | 10/2010 | Dougherty et al. | 709/217 |
| 2010/0299134 | A1 * | 11/2010 | Lam | 704/3 |
| 2011/0138074 | A1 * | 6/2011 | Onda et al. | 709/245 |
| 2011/0202832 | A1 | 8/2011 | Lum | |
| 2012/0162719 | A1 * | 6/2012 | Klaus | 358/3.13 |
| 2013/0063486 | A1 * | 3/2013 | Braun et al. | 345/633 |

OTHER PUBLICATIONS

Huynh, Nghia, "Automatic Text Detection in Complex Background Images", Retrieved at <<http://thesis.ece.curtin.edu.au/Thesis%202003/Nghia%/20Huynh%20-%2009904855/Huynh, % 20Nghia%20-%20Thesis%202003.pdf>>, Oct. 31, 2003, pp. 117.
Park, Thomas H., "Supporting Novice Development of Webpage Layoutsfor Multiple Display Devices", Retrieved at <<http://ieeexplore.ieee.org/stamp/stamp.jsp?tp=&arnumber=5635253>>, Visual Languages and Human-Centric Computing (VL/HCC), 2010 IEEE Symposium, Sep. 21, 2010, p. 261-262.

* cited by examiner

*Primary Examiner* — Kee M Tung
*Assistant Examiner* — Yi Wang
(74) *Attorney, Agent, or Firm* — Micah Goldsmith; Judy Yee; Micky Minhas

(57) ABSTRACT

Various embodiments are disclosed that relate to enhancing the display of images comprising text on various computing device displays. For example, one disclosed embodiment provides, on a computing device, a method of displaying an image, the method including receiving from a remote computing device image data representing a non-text portion of the image, receiving from the remote computing device unrendered text data representing a text portion of the image, rendering the unrendered text data based upon local contextual rendering information to form locally rendered text data, compositing the locally rendered text data and the image data to form a composited image, and providing the composited image to a display.

20 Claims, 5 Drawing Sheets

LOCAL RENDERING OF TEXT IN IMAGE

BACKGROUND

Text may be mixed with non-text content in many types of images presented on computing devices. Examples of images that may include text and non-text content include, but are not limited to, video game imagery and user interfaces displayed over other content. Such images may be produced by rendering the text and non-text content together, and then performing additional processing on the rendered image to format the image for a particular display device.

SUMMARY

Various embodiments are disclosed that relate to enhancing the display of images comprising text on various computing device displays. For example, one disclosed embodiment provides, on a computing device, a method of displaying an image including receiving from a remote computing device image data representing a non-text portion of the image, receiving from the remote computing device unrendered text data representing a text portion of the image, rendering the unrendered text data based upon local contextual rendering information to form locally rendered text data, compositing the locally rendered text data and the image data to form a composited image, and providing the composited image to a display.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
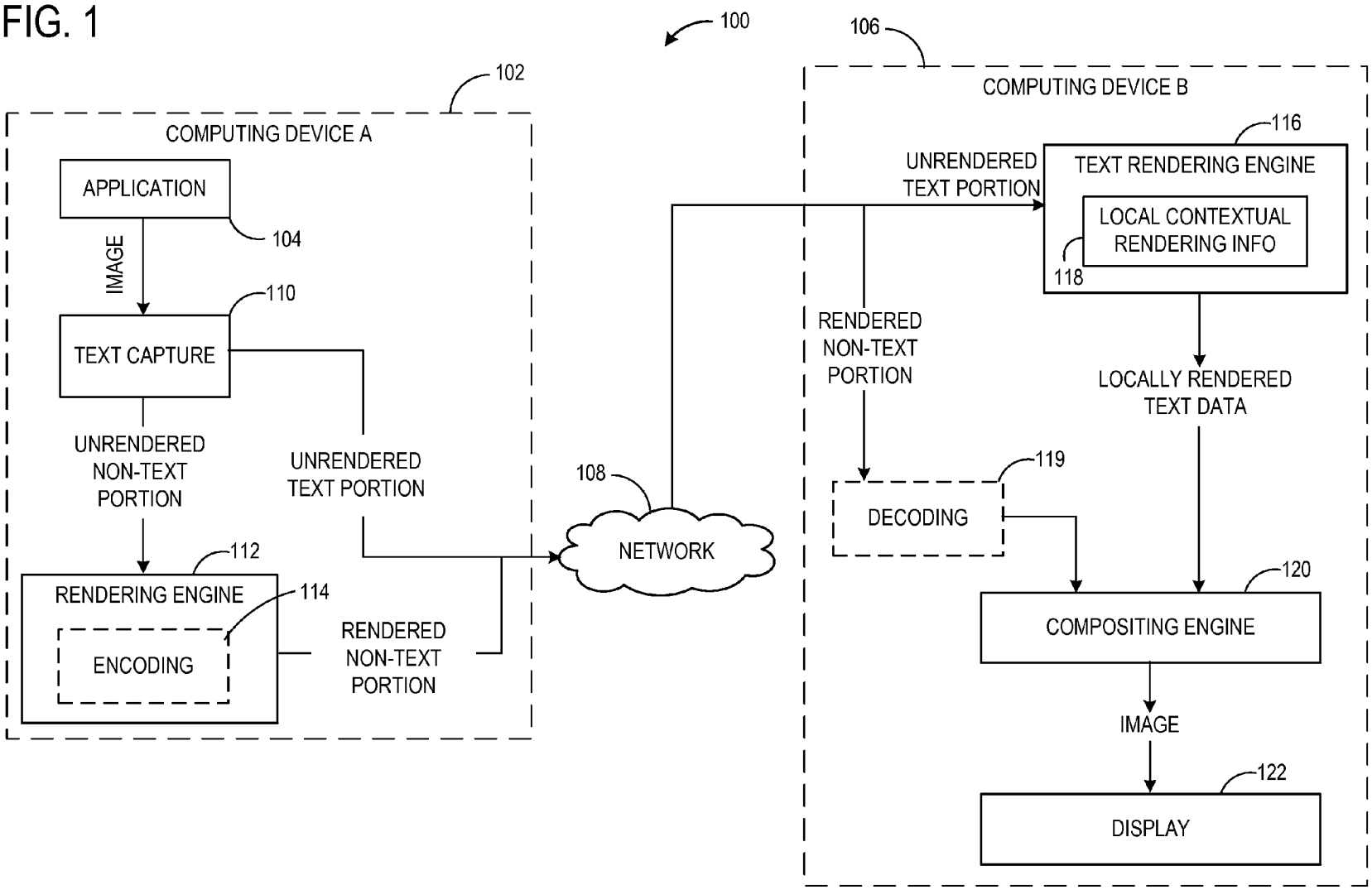
FIG. 1 shows an embodiment of a use environment for the local rendering of text in text-containing images.

As mentioned above, text and non-text content that are intended to be viewed together in a single image may be rendered together such that a single image comprising the text and the non-text content is produced for display. However, in some settings, such as with some digital televisions, near-eye displays, and even some monitors, text in such images may be perceived as being difficult to read, blurry, or otherwise having poor quality.

Various factors may contribute to such problems, including but not limited to differences between a device that produces the content and a display used to display the content, such as a mobile device rendering content for display on a near-eye display. For example, various features may differ between display devices, including but not limited to primary color-producing technologies, formats, resolutions, gamma corrections, and other such display-related factors. It is noted that such factors may be more noticeable when viewing the text portions of the image relative to the non-text portions, as the human eye may be more sensitive to errors in registration, resolution, color, etc. for text image data than non-text image data.

Further, in some settings, time-dependent contextual factors also may affect the appearance of text in a displayed image. For example, in the context of near-eye displays that employ head tracking, corrections (especially sub-pixel oriented corrections) may lead to blurring and loss of definition of characters. Also, a virtual object having displayed text may be constantly moving as a user moves through a virtual world, which may result in loss of detail as text characters are rotated relative to a viewing perspective. Further, with see-through display systems, a real-world background over which text is displayed may be constantly changing.

As an additional factor in text display, some text displayed on a near-eye display may be head-locked or world-locked. Head-locked text is text that is intended to be displayed at a specific location on a display screen such that the text does not move with the user's head. On the other hand, world-locked text is configured to be displayed at a specific location relative to the real world, and as such may move within a user's field of view as a user's head moves.

Accordingly, embodiments are disclosed herein that relate to rendering text and non-text portions of an image separately, utilizing local contextual rendering information to render the text portion of the image, and then compositing the rendered text and non-text portions of the image for display. The local contextual rendering information comprises information specific to the computing device and/or display used for viewing the image, and thus may be render representations of text for the particular capabilities and local context of that device. This is in contrast with the local rendering of text using global settings, as may be used with technologies such as Microsoft Windows Media Extender, which may not take into account the characteristics of a local computing and/or display device when rendering text locally. Rendering text locally based upon local contextual rendering information may help to avoid reductions in text quality arising from display-related processes such as scaling, frame rate conversion, gamma correction, head tracking correction, sharpening/smoothing filters, etc., that can warp, images, reduce or eliminate colors, smear images, and/or otherwise affect the appearance of text in images.

FIG. 1 shows a block diagram depicting an embodiment of a use environment 100 for the local rendering of text in images comprising text and non-text content. Use environment 100 comprises a computing device A 102 having an application 104 that generates images for display, and a computing device B 106 that receives and displays the images generated by computing device A 102. Computing device A 102 may be configured to produce any suitable text-containing images for display by computing device B 106. Examples include, but are not limited to, video images, video game images, and user interface images. Computing device A 102 is depicted as being connected to computing device B 106 via a network 108. It will be understood that network 108 may represent any suitable network or combination of networks, including but not limited to computer networks such as the Internet, and direct network connections, such as a WiFi Direct connection, Bluetooth connection, etc., as well as wired connections such as Universal Serial Bus (USB) connections, etc. It will be understood that computing devices A and B represent any suitable types of computing devices, including but not limited to desktop computers, laptop computers, notepad computers, mobile devices such as smart phones and media players, wearable computing devices (e.g. head-mounted display device and other ear-eye displays), network-accessible server computing devices, etc.

Computing device A 102 may be configured to render images from application 104 prior to sending the images to computing device B 106. However, as mentioned above, rendering the text in the image at computing device A 102 may impact the display of the text on computing device B 106 due to device-specific factors such as those mentioned above. Thus, computing device A 102 may comprise a text capture module 110 configured to separate text from images produced by application 104 prior to rendering of the image. The captured text may have any suitable format. Examples include, but are not limited to, a markup document format comprising tags that represent the appearance of the text in a display-neutral format, tags that define animations to be performed on the text, tags that define the text as head-locked or world-locked, and/or any other suitable tags.

Computing device A 102 further comprises a rendering engine 112 configured to render images from application 104 after removal of the text from the images. Rendering engine 112 may be configured to render the images in any suitable form, and further may include an encoder 114 configured to compress images after rendering. It will be noted that removal of text from images prior to rendering and encoding may allow the images to be compressed relatively more efficiently via methods such as MPEG compression, as including the text may introduce high frequency features that may result in less efficient compression. Likewise, markup text also may be stored and transmitted efficiently. Therefore, removal of the text for separate rendering local to the display device may reduce communication resources utilized by transfer of the image between devices, in addition to helping prevent distortion of text that may arise when rendering text with non-text portions of an image.

After rendering and potentially encoding, the rendered non-text portion and the unrendered text portion of the image are transmitted to computing device B 106 for display. Computing device B comprises a text rendering engine 116 configured to utilize local contextual rendering information 118 to render the text for display. As mentioned above, local contextual rendering information 118 may comprise any suitable information that may be used in rendering the text portion of the image based upon the particular computing device and/or display device used to display the image. Examples of types of local contextual rendering information that include, but are not limited to, a capability of one or more of the computing device and the display, such as a display technology utilized by the display device, a color space utilized by the display device, a contrast ratio of the display device, and other such display-specific information.

The local rendering of text based upon device capabilities may help in device power management, for example, by allowing a text rendering device (e.g. computing device B 106) to take advantage of the particular primary color emitters used for a display device (e.g. OLED, laser/LED projection, and others). This also may allow the rendering device to take into account the efficiencies of specific light sources (e.g. lasers and/or LEDs) to compensate for chromatic variation in projection systems such as near-eye displays and pico-projectors, and utilize content-adaptive backlight control on displays such as RGB-W displays.

In some embodiments, local contextual rendering information 118 may further comprise information regarding a time-dependent local context of the computing device and/or display device used to display the image. In such embodiments, local contextual rendering information 118 also may comprise one or more rule sets to be applied to the time-dependent context to determine whether to apply a specific parameter to the local rendering of the text portion of the image.

As one example of time-dependent local context, a player navigating a virtual world environment (e.g. a video game) using a near-eye display system may be able to move within the world relative to objects, such that the perspective of the objects changes over time. As such, text-containing signs, etc. within the world may be viewed at different angles. When text-containing objects are viewed at higher angle relative to a direction normal to a text plane of the object and/or at larger distances, some text fonts may be more difficult to read than others. Therefore, the time-dependent context may comprise information regarding one or more of a distance of translation and an angle of rotation of a virtual object at which the text is displayed in the image relative to a viewing perspective. Such contextual information may be derived in any suitable manner, including but not limited to from head position data and display orientation data received from sensors (e.g. inertial motion sensors and/or image sensors) that track user motions in the virtual environment. Likewise, the rule set may comprise one or more of a threshold distance of translation and a threshold angle of rotation at which to apply a specified text style. In this matter, text may be rendered in an easier-to-read font when displayed at a high angle and/or large virtual distance relative to a viewer's perspective. This is described with more detail below with reference to FIGS. 2-4.

As another example, in the case of a see-through display system (e.g. a head-mounted display system), as a user moves through the physical world wearing such a display system, the visual characteristics of the background scene the user views through the see-through display system may change, which may affect the contrast of text (e.g. user interface text) against the background. Thus, the time-dependent context may comprise a real background image viewable through a see-through display. Likewise, the rule set may comprise one or more specified text styles to be applied based upon a visual characteristic of the background image, such as a color, texture, or other visual characteristic.

As yet another example, some near-eye displays may be configured to detect a location on the display at which a user is currently gazing. Such gaze detection may be performed in a head-mounted display system via image sensors that detect a direction in which the user's eyes are directed, potentially with the aid of light sources that project spots of light onto the surface of a user's eye to allow the detection of glints from the eye's surface. Rendering text at a higher resolution may be more computationally intensive than rendering text at a lower resolution, Thus, the time-dependent context may comprise information regarding a gaze location on the display at which the user is gazing, and the rule set may comprise a threshold distance from the gaze location at which text is rendered at a lower resolution than at distances less than the threshold distance.

As yet another example, local contextual rendering information also may include information regarding rendering parameters to be applied in specific real and/or virtual lighting situations (e.g. where visor dimming is used in conjunction with a near-eye display), which may alter color matching compared to other lighting environments.

Locally rendering a text portion of an image and then compositing the rendered text with a non-text portion of the image may offer other advantages as well. For example, the text portion may be rendered at a higher resolution than the non-text portion to preserve the sharpness of text when down-sampling an image.

Further, text can be locally rendered at different frame rates than the frame rate of the non-text portion of images. For example, text may be locally updated at a higher frame rate than the frame rate of a video content item in which the text is displayed. This may be employed when locally animating text to update the text animation more frequently than the video frame rate, such as during scrolling of text on the display. This also may allow for more rapid adjustment to conditions such as changing ambient light levels.

Likewise, text may be locally rendered at a lower frame rate than the video frame rate. This may be employed, for example, when displayed text does not change between frames (e.g. when a user is remaining stationary in a video game). Further, where displayed text changes a small amount between images, for example, when a user changes perspective slightly in a virtual environment, updating may be performed by geometric transform of the displayed text based upon the change in perspective, rather than by re-rendering the text. In such an embodiment, the rendering rate may be increased, for example, when a rate (spatial and/or temporal) at which the image perspective is changing meets or exceeds a threshold level, and then decreased when the rate of change drops below the threshold.

Continuing with FIG. 1, after rendering (and potentially decoding 119 of the non-text portion of the image), the locally rendered text portion and the rendered non-text portion of the image are each provided to a compositing engine 120 configured to composite the rendered text and non-text portions of the image into a final image for presentation via display 122. In some embodiments, compositing engine 120 further may be configured to apply a Z-order to features in the text portion and/or non-text portion of the image to thereby represent occlusion of the text by non-text features in the image. In such embodiments, a value representing the Z-order may be captured via text capture module 110. In other embodiments, text may be assigned a topmost Z-order in the image such that the text is not occluded by non-text features. It will be understood that the compositing engine 120 also may be configured to apply any other parameters that affect the appearance of the text portion and non-text portion of the image, such as transparency parameters.

Figure 2:
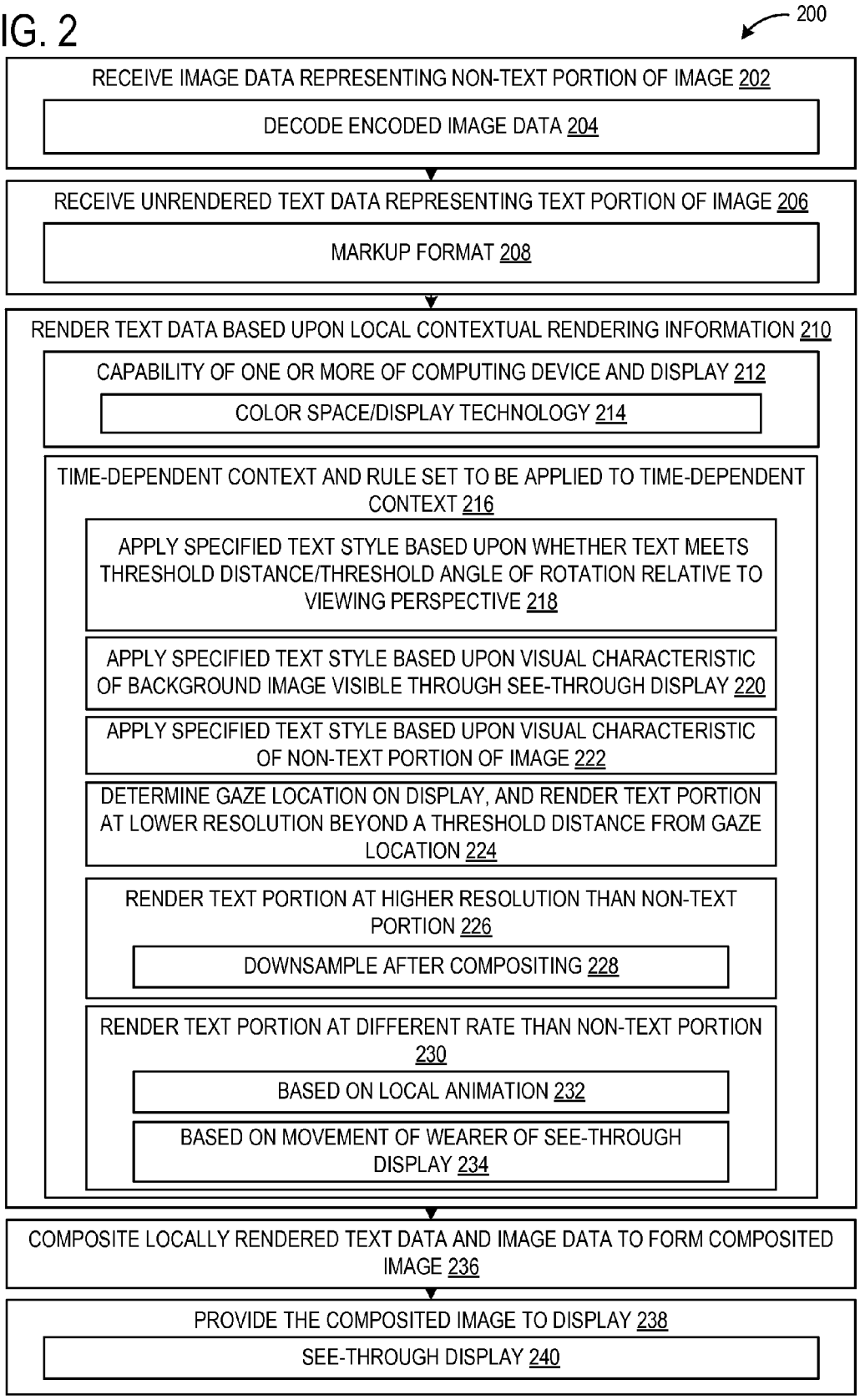
FIG. 2 shows an embodiment of a method of a method of locally rendering text for a text-containing image by utilizing local contextual rendering information.

FIG. 2 shows an embodiment of a method 200 for displaying images by locally rendering a text portion of an image and then compositing the locally rendered text portion with a rendered non-text portion. Method 200 comprises, at 202, receiving image data representing a non-text portion of the image. As the image data may be encoded, method 200 may comprise, at 204, decoding the encoded image data. Method 200 further comprises, at 206, receiving unrendered text data representing a text portion of the image, wherein the unrendered text data is received in a display-neutral format. The unrendered text data may have any suitable format, including but not limited to a markup text format, as indicated at 208.

Next, at 210, method 200 comprises rendering text data based upon local contextual rendering information. The local contextual rendering information may comprise any suitable information for rendering text data based upon the local display device on which it will be displayed. For example, as described above, the local contextual rendering information may comprise a capability of one or more of the computing device and the display, such as a color space and/or display technology 214 utilized by the display device. Such information also may include information on the colors and efficiencies of the primary color light sources utilized by the display, and the like. It will be understood that these capabilities are presented for the purpose of example, and are not intended to be limiting in any manner.

As mentioned above, and as indicated at 216, the local contextual rendering information also may comprise a time-dependent context, and also a rule set comprising one or more rules to apply to the time-dependent context to determine a parameter to apply during text rendering. Any suitable time-dependent context may be used as time-dependent local contextual rendering information, and any suitable rule may be applied based upon the time-dependent context. For example, as shown at 218, the time-dependent context may comprise a distance of translation and/or an angle of rotation of text displayed on a virtual object relative to a viewing perspective. In such an instance, the set of rules may comprise one or more rules regarding a text style to apply if a threshold distance and/or angle of rotation of the virtual object is exceeded. The term "text style" as used herein refers to any aspect of the appearance of the text portion of an image, including but not limited to font, size, color, transparency, emphasis (italics, underline, bold, etc.), and/or any other suitable aspect of text appearance.

Figure 3A:
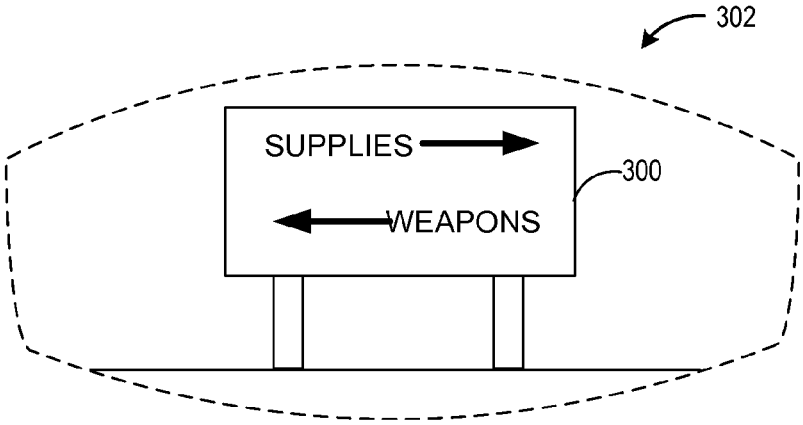
FIGS. 3A-3C illustrate the rendering of text on a virtual object in an image in a selected font based upon a change in angle of perspective.
Figure 3B:
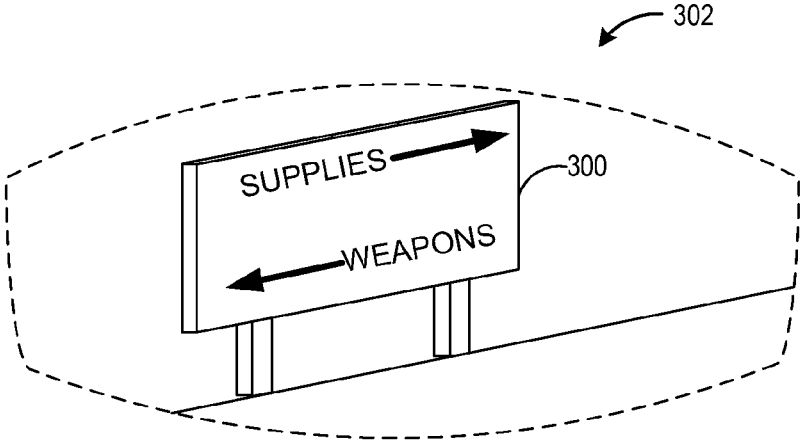
Figure 3C:
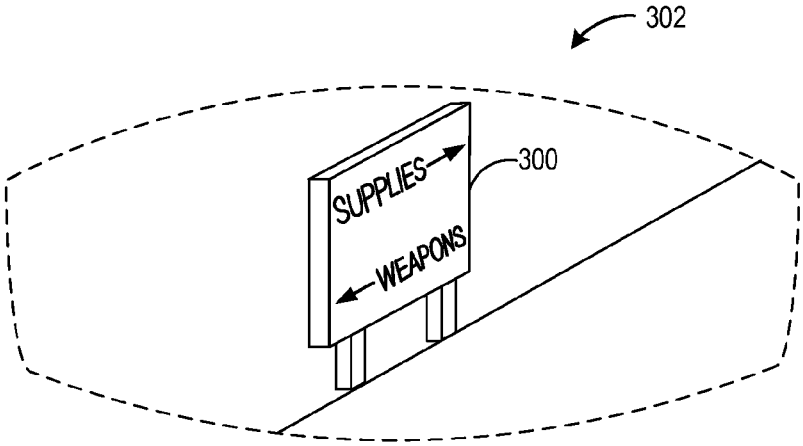

FIGS. 3A-3C illustrate an example of applying a specified style to text upon rotation of a text-bearing virtual object past a threshold rotation. First referring to FIG. 3A, a virtual object in the form of a sign 300 in a virtual world is shown displayed on a near-eye display, represented by outline 302. In the perspective of FIG. 3A, sign 300 is viewed directly from a front side, and the text on sign 300 is easily readable in its original font. Next referring to FIG. 3B, sign 300 is illustrated from a different perspective within the virtual world, as it may appear to a user that has moved relative to sign 300 in the virtual world. At the degree of rotation displayed in FIG. 3B, the text is still readable in the original font. However, as rotation continues, the depicted text may be more difficult to view. Thus, at the perspective illustrated in FIG. 3C, the rotation of the text on sign 300 relative to the viewing perspective has exceeded a threshold rotation, and the text has been rendered in a different font that is specified where the threshold is met. In this manner, with appropriate selection of the high-angle font, situations where letters may begin to resemble other letters (e.g. where "R" may begin to resemble "P" or "I") may be avoided until characters become too small (e.g. below 5×5 pixels).

Figure 4A:
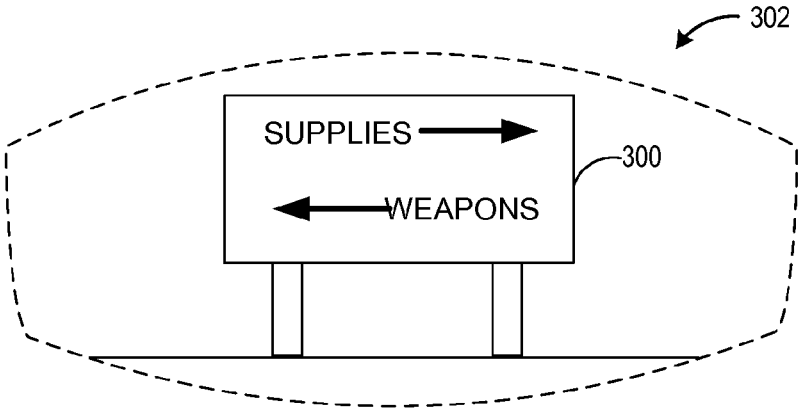
FIGS. 4A-4C illustrate the rendering of text on a virtual object in a selected font based upon a change in apparent distance of the virtual object.
Figure 4B:
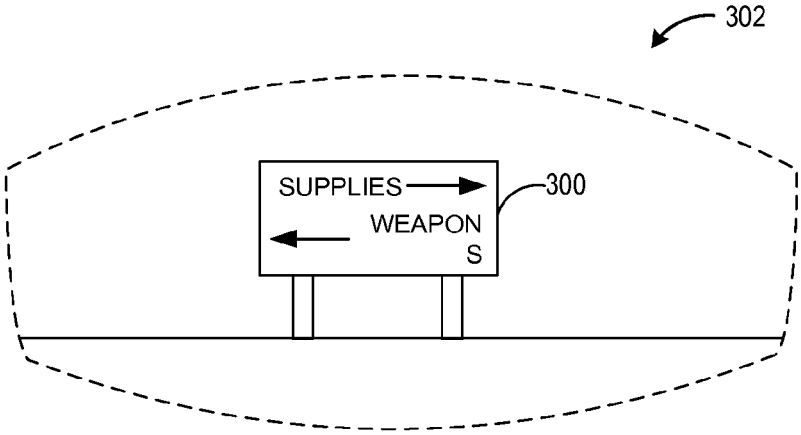
Figure 4C:
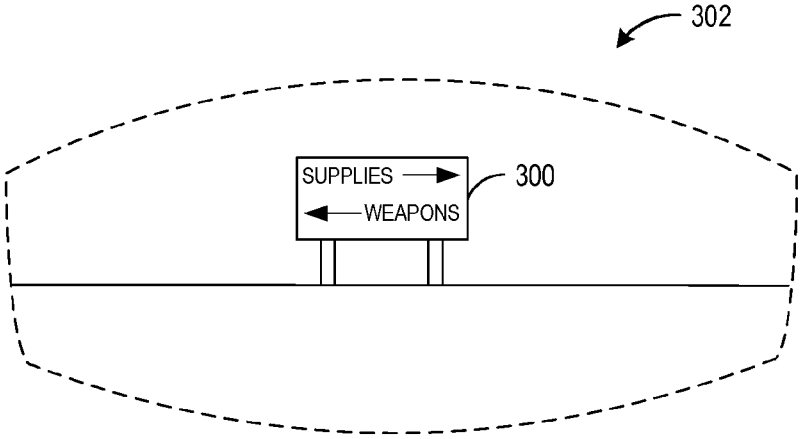

FIGS. 4A-4C illustrate an example of applying a specified style to text upon an apparent distance of a text-bearing virtual object increasing past a threshold distance. First referring to FIG. 4A, sign 300 is shown displayed on near-eye display 302 at a first, relatively close distance from the viewing perspective, and the text on the sign is easily readable in its original font. Next referring to FIG. 4B, sign 300 is illustrated from a second, farther distance from the viewing perspective. At this perspective, the font is still readable in its original font. However, as the apparent distance of the virtual object from the viewing perspective continues to increase, the depicted text may be more difficult to view. Thus, at the perspective illustrated in FIG. 4C, the distance of the text on the sign relative to the viewing perspective has exceeded a threshold rotation, and the text has been rendered in a different font that is specified where the threshold is met. While the example of FIG. 4 shows translation in a direction parallel to a normal of the text plane of the image, it will be understood that translation in other directions may be addressed in a similar manner to that shown. Further, while the examples of FIGS. 3 and 4 illustrate the application of a specified font when a threshold rotation and distance are respectively met, it will be understood that any other suitable change in text style may be applied to help make rendered text easier to read.

Returning to FIG. 2, the time-dependent context also may comprise a visual characteristic of a background image visible through a see-through display, as indicated at 220. Examples of such visual characteristics include, but are not limited to, color and texture. The background image may be detected via outward-facing image sensors on a see-through display, or in any other suitable manner. In such embodiments, the rule set may comprise one or more rules specifying a text style to apply based upon a quantification of the visual characteristic. For example, if the background image is highly textured with much high-frequency information, a rule may specify a font that is easier to read over a background meeting a threshold level of high-frequency information. Likewise, if the background image includes a surface with a particular color that would make the original font of displayed text difficult to read, a rule may specify a higher contrast color to use for the text. As indicated at 222, similar analyses and rules may be applied to the non-text portion of the image to be displayed, such that specified text styles are displayed based upon one or more visual characteristics of the non-text portion of the image. Background image data, whether real or virtual, also may be used to rendered a text border comprising colors from the background image over which the text is to be displayed. This may help to blend the text more smoothly with the scene. It will be understood that these background image characteristics may be quantified in any suitable manner.

Further, as described above, the time-dependent context also may comprise a location on the display at which the user is gazing, as determined by gaze analysis. In such embodiments, as indicated at 224, the rule may specify a threshold distance from the gaze location at which to render the text at a lower resolution. For example, in addition to the word at which the user is gazing, the words immediately preceding and following that word may be rendered at higher resolution. It will be understood that the embodiments of time-dependent contexts described above are presented for the purpose of example, and are not intended to be limiting in any manner, as any suitable time-dependent contextual information may be considered when locally rendering a text portion of an image.

The local rendering of text portions of images may offer further advantages than those described above. For example, as indicated at 226, the text portion of the image may be rendered at a higher resolution than the non-text portion of an image. This may allow the display of clear and sharp text even where the image has been blurred or otherwise degraded. This may be helpful, for example, in allowing for saving of computational resources in rendering game/animation/hologram content at a lower resolution while mixing the lower resolution content with high-quality, easily-readable text content. Further, as indicated at 228, text that is rendered at higher resolution may be downsampled along with the image after compositing with the non-text portion of the image. This may allow the text portion to have a desired resolution even where the image as a whole is downsampled.

As mentioned above, in addition to aiding in the display of easy-to-read text, locally rendering text portions of images separately from non-text portions also may allow the text and non-text portions of an image to be updated at different rates, as indicated at 230. For example, where local text animation is performed, as indicated at 232, the animation may be updated at a higher refresh rate than the frame rate at which the non-text portions of images are updated. The rate at which text is rendered also may be changed based upon movement of a display that utilizes motion tracking (e.g. a head tracking near-eye display), as indicated at 234. For example, where the text content and perspective displayed on a see-through display device is not changing between frames (e.g. where a wearer of a head-mounted display is not moving), the text may be rendered at a lower frame rate than the frame rate of the non-text portions. Where such quantities are changing, but where the changes are not significant, the text may be adjusted via geometrical transform, rather than re-rendering. Likewise, when the user is more actively moving, thereby causing the perspective of displayed text to change more rapidly, the rate at which the text portion of images is rendered may be increased. Further, text in different types of content may be rendered differently based upon movement. For example, static content such as a web page may be updated through geometrical transform when small changes in head position occur, while videos, games, and other dynamic content may have each frame rendered separately.

Method 200 next comprises, at 236, compositing the locally rendered text data and non-text image data to form a composited image, and providing the composited image to a display, as indicated at 238. The composited image may be provided to any suitable display. Examples include, but are not limited to, see-through display devices 240, such as head-mounted displays, as well as digital televisions, monitors, mobile devices, and/or any other suitable display devices.

It will be understood that the potential scenarios and benefits described above regarding the local rendering of text using local contextual rendering information are presented for the purpose of example, and that such local rendering may be used in any other suitable scenario. For example, some near-eye display devices may use pixel opacity to blur or reduce the real environment behind a displayed image. However, displaying text may not lend itself well to out-of-focus solutions such as pixel opacity, which may lead to text blurring. Therefore, rendering text local to the display device may allow for text-based pixel opacity at the display device. Pixel opacity may be applied in any suitable manner. For example, in some embodiments, pixel opacity may be applied to an entire text region, thereby effectively blurring and/or blocking the real world behind the text. Further, a background color may be applied to a blocked region behind text for enhanced viewing. As one specific example, pixel opacity may be used to apply a white background behind black or clear text, wherein the white background is applied fully behind the text zone.

As described with reference to FIG. 1, the above described methods and processes may be tied to a computing system including one or more computers. In particular, the methods and processes described herein may be implemented as a computer application, computer service, computer API, computer library, and/or other computer program product.

Figure 5:
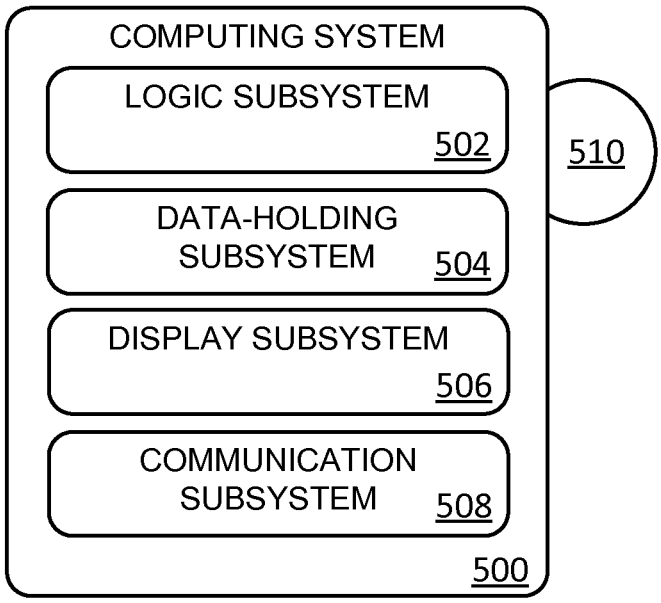
FIG. 5 shows a block diagram of an example computing device.

FIG. 5 schematically shows a nonlimiting computing system 500 that may perform one or more of the above described methods and processes. Computing system 500 is shown in simplified form. It is to be understood that virtually any computer architecture may be used without departing from the scope of this disclosure. In different embodiments, computing system 500 may take the form of a mainframe computer, server computer, desktop computer, laptop computer, tablet computer, home entertainment computer, network computing device, mobile computing device, mobile communication device, gaming device, etc.

Computing system 500 includes a logic subsystem 502 and a data-holding subsystem 504. Computing system 500 may optionally include a display subsystem 506, communication subsystem 508, and/or other components not shown in FIG. 5.

Computing system 500 may also optionally include user input devices such as keyboards, mice, game controllers, cameras, microphones, and/or touch screens, for example.

Logic subsystem 502 may include one or more physical devices configured to execute one or more instructions. For example, the logic subsystem may be configured to execute one or more instructions that are part of one or more applications, services, programs, routines, libraries, objects, components, data structures, or other logical constructs. Such instructions may be implemented to perform a task, implement a data type, transform the state of one or more devices, or otherwise arrive at a desired result.

The logic subsystem may include one or more processors that are configured to execute software instructions. Additionally or alternatively, the logic subsystem may include one or more hardware or firmware logic machines configured to execute hardware or firmware instructions. Processors of the logic subsystem may be single core or multicore, and the programs executed thereon may be configured for parallel or distributed processing. The logic subsystem may optionally include individual components that are distributed throughout two or more devices, which may be remotely located and/or configured for coordinated processing. One or more aspects of the logic subsystem may be virtualized and executed by remotely accessible networked computing devices configured in a cloud computing configuration.

Data-holding subsystem 504 may include one or more physical, non-transitory, devices configured to hold data and/or instructions executable by the logic subsystem to implement the herein described methods and processes. When such methods and processes are implemented, the state of data-holding subsystem 504 may be transformed (e.g., to hold different data).

Data-holding subsystem 504 may include removable media and/or built-in devices. Data-holding subsystem 504 may include optical memory devices (e.g., CD, DVD, HD-DVD, Blu-Ray Disc, etc.), semiconductor memory devices (e.g., RAM, EPROM, EEPROM, etc.) and/or magnetic memory devices (e.g., hard disk drive, floppy disk drive, tape drive, MRAM, etc.), among others. Data-holding subsystem 504 may include devices with one or more of the following characteristics: volatile, nonvolatile, dynamic, static, read/write, read-only, random access, sequential access, location addressable, file addressable, and content addressable. In some embodiments, logic subsystem 502 and data-holding subsystem 504 may be integrated into one or more common devices, such as an application specific integrated circuit or a system on a chip.

FIG. 5 also shows an aspect of the data-holding subsystem in the form of removable computer-readable storage media 510, which may be used to store and/or transfer data and/or instructions executable to implement the herein described methods and processes. Removable computer-readable storage media 510 may take the form of CDs, DVDs, HD-DVDs, Blu-Ray Discs, EEPROMs, and/or floppy disks, among others.

It is to be appreciated that data-holding subsystem 504 includes one or more physical, non-transitory devices. In contrast, in some embodiments aspects of the instructions described herein may be propagated in a transitory fashion by a pure signal (e.g., an electromagnetic signal, an optical signal, etc.) that is not held by a physical device for at least a finite duration. Furthermore, data and/or other forms of information pertaining to the present disclosure may be propagated by a pure signal.

The terms "module," "program," and "engine" may be used to describe an aspect of computing system 500 that is implemented to perform one or more particular functions. In some cases, such a module, program, or engine may be instantiated via logic subsystem 502 executing instructions held by data-holding subsystem 504. It is to be understood that different modules, programs, and/or engines may be instantiated from the same application, service, code block, object, library, routine, API, function, etc. Likewise, the same module, program, and/or engine may be instantiated by different applications, services, code blocks, objects, routines, APIs, functions, etc. The terms "module," "program," and "engine" are meant to encompass individual or groups of executable files, data files, libraries, drivers, scripts, database records, etc.

It is to be appreciated that a "service", as used herein, may be an application program executable across multiple user sessions and available to one or more system components, programs, and/or other services. In some implementations, a service may run on a server responsive to a request from a client.

When included, display subsystem 506 may be used to present a visual representation of data held by data-holding subsystem 504. As the herein described methods and processes change the data held by the data-holding subsystem, and thus transform the state of the data-holding subsystem, the state of display subsystem 506 may likewise be transformed to visually represent changes in the underlying data. Display subsystem 506 may include one or more display devices utilizing virtually any type of technology. Such display devices may be combined with logic subsystem 502 and/or data-holding subsystem 504 in a shared enclosure, or such display devices may be peripheral display devices.

When included, communication subsystem 508 may be configured to communicatively couple computing system 500 with one or more other computing devices. Communication subsystem 508 may include wired and/or wireless communication devices compatible with one or more different communication protocols. As nonlimiting examples, the communication subsystem may be configured for communication via a wireless telephone network, a wireless local area network, a wired local area network, a wireless wide area network, a wired wide area network, etc. In some embodiments, the communication subsystem may allow computing system 500 to send and/or receive messages to and/or from other devices via a network such as the Internet.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. On a computing device comprising a see-through display and an outward-facing camera configured to acquire image data of a real-world background for display on the see-through display, a method of displaying an image, the method comprising:

receiving via a network from a remote computing device rendered image data representing a non-text portion of the image;

receiving via the network from the remote computing device unrendered text data representing a text portion of the image, the unrendered text data comprising text in a display-neutral markup format comprising markup specifying whether the text is to be displayed at a fixed location relative to a see-through display screen or a fixed position relative to a real-world background image;

at the computing device, locally rendering the unrendered text data based upon local contextual rendering information to form locally rendered text data, the local contextual rendering information comprising information regarding a time-dependent context of the real-world background;

compositing the locally rendered text data and the rendered image data to form a composited image; and providing the composited image to the see-through display.

2. The method of claim 1, wherein the local contextual rendering information comprises information regarding a capability of one or more of the computing device and the see-through display.

3. The method of claim 2, wherein the local contextual rendering information comprises information regarding one or more of a color space and a display technology utilized by the see-through display.

4. The method of claim 1, wherein the information regarding the time-dependent context comprises information regarding one or more of the computing device and the display, and also comprises a rule set to be applied to the time-dependent context.

5. The method of claim 4, wherein the information regarding the time-dependent context comprises information regarding one or more of a distance and an angle of rotation of a virtual object on which the text is to be displayed in the image.

6. The method of claim 5, wherein the rule set comprises one or more of a threshold distance and a threshold angle of rotation at which to apply a specified text style.

7. The method of claim 4, wherein the information regarding the time-dependent context comprises a visual characteristic of the real-world background, and wherein the rule set comprises a specified text style based upon the visual characteristic.

8. The method of claim 4, wherein the information regarding the time-dependent context comprises the non-text portion of the image, and wherein the rule set comprises a specified text style based upon a visual characteristic of the non-text portion of the image.

9. The method of claim 4, wherein the information regarding the time-dependent context comprises information regarding a gaze location on the display at which the user is gazing, and wherein the rule set comprises a threshold distance from the gaze location at which text is rendered at a lower resolution than at distances less than the threshold distance.

10. The method of claim 1, further comprising rendering the unrendered text data at a higher resolution than a resolution of the non-text portion.

11. The method of claim 1, further comprising rendering the unrendered text data at a rendering rate based upon a rate at which an image perspective is changing between image frames as detected by a motion sensor.

12. The method of claim 1, further comprising rendering local animation of the unrendered text at a higher frame rate than a frame rate at which the image is updated.

13. The method of claim 1, wherein the rendered image data representing the non-text portion is received as a compressed image, and the unrendered text data is received as markup text.

14. The method of claim 1, wherein rendering the unrendered text data comprises rendering the text data at a first, higher resolution and then downsampling the locally rendered text data to a second, lower resolution after compositing.

15. A computing device, comprising:

a logic subsystem configured to execute instructions; and a data-holding subsystem comprising instructions stored thereon that are executable by the logic subsystem to:

receive an image for rendering prior to transmitting to a receiving device, the image comprising a text portion and a non-text portion;

prior to rendering the image, separate the text portion from the non-text portion;

render the non-text portion to form a rendered non-text portion;

represent the text portion as unrendered text in a display-neutral markup format comprising markup specifying whether the text is to be displayed at a fixed location relative to a display screen or a fixed position relative to a real-world background image; and send the rendered non-text portion and the unrendered text to the receiving device.

16. The computing device of claim 15, wherein the instructions are further executable to compress the rendered non-text portion of the image.

17. A see-through display system, comprising:

a see-through display;

an outward-facing camera configured to acquire image data of a real-world background for display on the see-through display;

a computing device comprising a logic subsystem; and a data-holding subsystem comprising instructions stored thereon that are executable by the logic subsystem to:

receive via a network from a remote computing device rendered image data representing a non-text portion of the image;

receive via the network from the remote computing device display-neutral unrendered text data representing a text portion of the image, the display-neutral unrendered text data comprising markup specifying whether the text is to be displayed at a fixed location relative to a display screen or a fixed position relative to a real-world background image;

detect a time-dependent context comprising information regarding the real-world background;

at the computing device, locally render the display-neutral unrendered text data utilizing local contextual rendering information comprising a rule set specific to the time-dependent context detected to form locally rendered text data;

composite the locally rendered text data and the rendered image data to form a composited image; and present the composited image on the see-through display.

18. The see-through display system of claim 17, wherein the time-dependent context comprises information regarding one or more of a distance and an angle of rotation of a virtual object on which the text is to be displayed in the image, and wherein the rule set comprises one or more of a threshold distance and a threshold angle of rotation at which to apply a specified text style.

19. The see-through display system of claim 17, wherein the rule set comprises a specified text style based upon a visual characteristic of the real-world background image.

20. The see-through display system of claim 17, wherein the time-dependent context comprises information regarding a gaze location on the display at which the user is gazing, and wherein the rule set comprises a threshold distance from the gaze location at which text is rendered at a lower resolution than at distances less than the threshold distance.

* * * * *